United States Patent [19]

Pattison et al.

[11] Patent Number: 4,706,720

[45] Date of Patent: Nov. 17, 1987

[54] CLEAN FUNNEL

[76] Inventors: O. H. Pattison; Will Pattison, both of Star Rte.-Box 58, Clovis, N. Mex. 88101

[21] Appl. No.: 842,271

[22] Filed: Mar. 21, 1986

[51] Int. Cl.[4] ..... B67C 11/00

[52] U.S. Cl. ..... 141/327; 141/339; 215/1 R; 215/316; 215/321; 215/329

[58] Field of Search ..... 141/331–345, 141/325, 326, 327; 215/1 R, 316, 321, 329

[56] References Cited

U.S. PATENT DOCUMENTS

| | | | |
|---|---|---|---|
| 573,333 | 12/1896 | Krimmel | 141/339 |
| 2,448,893 | 9/1948 | Lamar | 215/43 |
| 2,884,151 | 4/1959 | Biederman | 215/41 |
| 3,750,722 | 8/1973 | Nowak | 141/327 |
| 3,899,012 | 8/1975 | Sather | 141/331 |

*Primary Examiner*—Houston S. Bell, Jr.
*Attorney, Agent, or Firm*—Robert W. Weig

[57] ABSTRACT

A clean funnel including a funnel shaped housing having a large substance intake opening and a small substance outlet opening; an entirely removable first closure cap for sealing the large substance intake opening and an entirely removable second closure cap for sealing the small substance outlet opening, the first cap and the second cap each being sufficiently tight when in place to remain in place under conditions of funnel handling and movement and to prevent contamination of the funnel during periods of nonuse.

9 Claims, 2 Drawing Figures

CLEAN FUNNEL

SUMMARY

For many years, various types and designs of funnels have been used in both industry and home applications for the transfer of both liquid and granulated substances from one container to another by use of a funnel device. Typically the funnel has a large opening that is tapered to a smaller opening which directs and concentrates the flow of material.

Various funnels for domestic and industrial use include a method of capping or sealing at one end of the funnel to restrict or block the flow of material. The proposed CLEAN FUNNEL is a device having a cap or closure at each end of the funnel. The dual closures provide a method for preventing dirt or contamination from entering the funnel during periods of nonuse, thereby maintaining cleanliness and freedom of contamination.

The closures may be secured by either threading both the large and small openings or by a slip cap device which will enclose the respective ends of the funnel device.

DESCRIPTION

Figure 1:
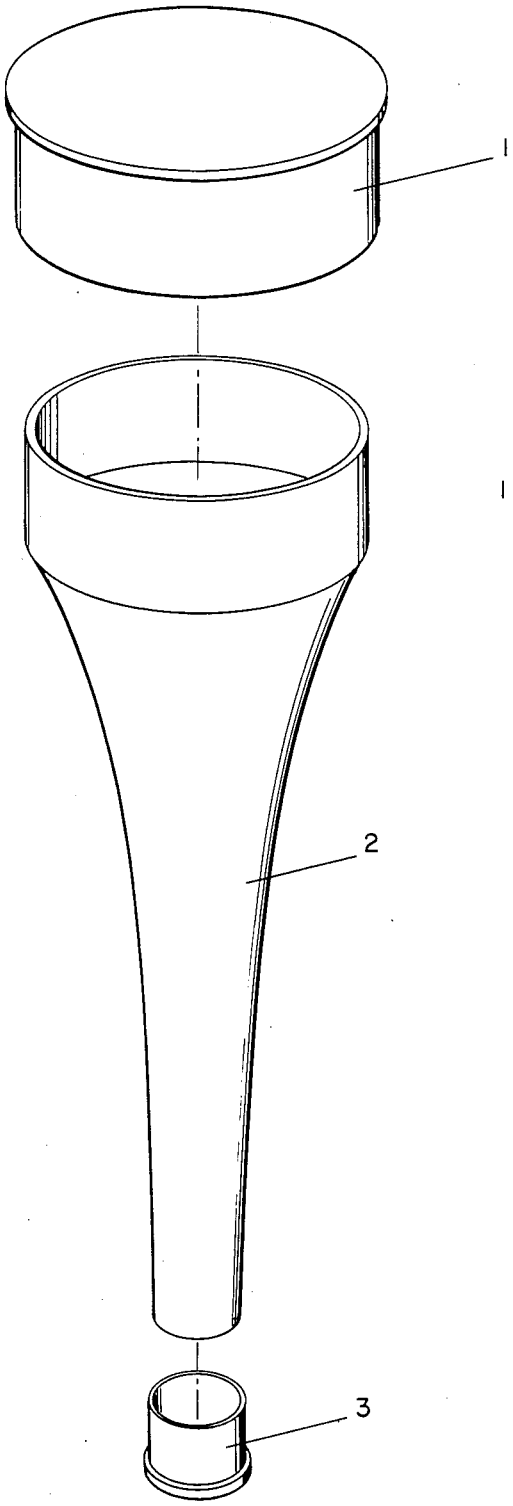
FIG. 1 shows the CLEAN FUNNEL with the caps or plugs for each end removed. In this position, the funnel could be used for the conveyance and transfer of materials.

Referring to the drawings, Numeral 2 indicates the body of the funnel, Numeral 1 indicates the larger cap or plug for the top opening and Numeral 3 indicates the smaller cap or plug for the bottom opening.

In FIG. 1, the larger cap or plug 1 is shown removed from the top opening of the funnel body 2 and the smaller cap or plug 3 is shown removed from the bottom opening of the funnel body 2.

Figure 2:
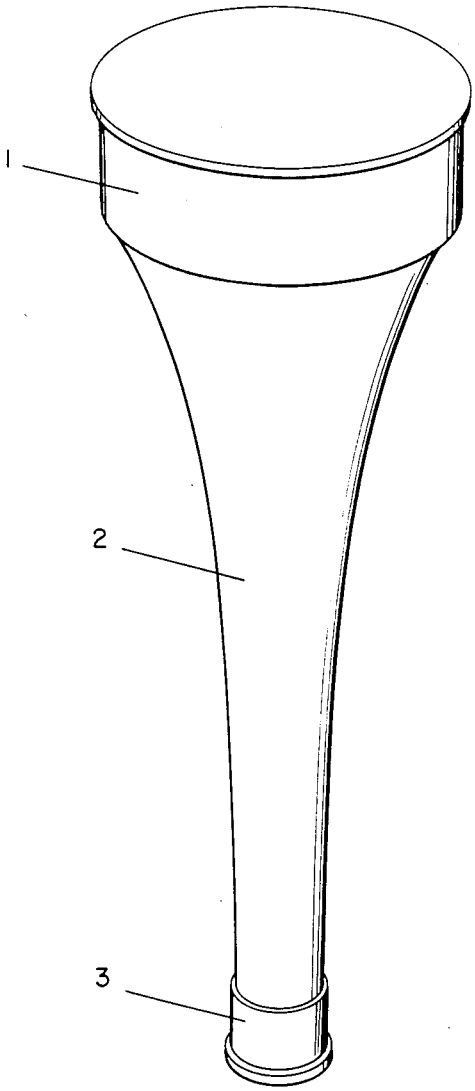
FIG. 2 shows the funnel with the caps or plugs fitted to each end of the funnel. The funnel would be stored as shown in FIG. 2 to prevent contamination of the inside of the funnel. The funnel would then be clean and ready for use in the future merely by removing the caps or plugs as shown in FIG. 1 for reuse.

In FIG. 2 the larger cap or plug 1 and the smaller cap or plug 3 are shown fitted to each end of the funnel body 2.

In the farming, ranching, lumber, petroleum, construction, mining, manufacturing and service industries; in homes, schools, offices, stores and shops; in fact, in any human activity where liquids, powders or other free running substances are transferred from containers into small openings, funnels are used to facilitate this transfer. Many times the problem occurs of not having a clean funnel readily available for use.

The CLEAN FUNNEL is a funnel with removable caps or plugs fitted to each opening, and makes available, when needed for use, a funnel free of foreign contamination.

The CLEAN FUNNEL is manufactured so that caps or plugs are fitted to each opening. The caps or plugs are removed when the funnel is in use. After the CLEAN FUNNEL is used, the caps or plugs are replaced and the funnel stored with or without having been cleaned of the substance poured through it. The next time the funnel is used, it wil be free of dust, dirt, grit, or any other type of foreign contaminants. The body of the funnel may be as shown in FIGS. 1 and 2 or of any similar design commonly used for the transmission of liquids and powders from one container to another. The unique and distinguishing feature of this invention is the capping or plugging of both ends of the funnel. In this manner, the interior of the funnel is protected during periods of nonuse from contamination. The funnel may either be cleaned after use and stored in its clean condition, or capped without cleaning to be subsequently used for funneling of the same or a similar substance without becoming dirty or contaminated.

While the specific embodiment of a funnel protected from foreign contaminants by caps or plugs fitted to each opening has been disclosed in the foregoing description, it is understood that various modifications within the spirit of the invention may occur to those skilled in the art. Therefore, it is intended that no limitations be placed on the invention except as defined by the scope of the appended claims.

What is claimed is:

1. A clean funnel comprising:

a funnel shaped housing having a large substance intake opening and a small substance outlet opening;

an entirely removable first closure cap means for sealing said large substance intake opening and an entirely removable second closure cap means for sealing said small substance outlet opening, said first closure cap means and said second closure cap means each being sufficiently tight when in place to remain in place under conditions of funnel handling and movement and to prevent contamination of said funnel during periods of nonuse.

2. The invention of claim 1 wherein at least one of said closure cap means comprises a slip cap.

3. The invention of claim 1 wherein at least one of said closure cap means comprises a clip plug.

4. The invention of claim 1 wherein at least one of said openings comprises a threaded lip and its corresponding closure cap means comprises a threaded cap.

5. The invention of claim 1 wherein at least one of said openings comprises an internal threaded portion and its corresponding closure cap means comprises a threaded plug.

6. The invention of claim 1 wherein said funnel shaped housing comprises a somewhat flexible material.

7. The invention of claim 1 wherein at least one of said closure cap means comprises a somewhat flexible material.

8. The invention of claim 1 wherein said funnel shaped housing comprises a substantially rigid material.

9. The invention of claim 1 wherein at least one of said closure cap means comprises a substantially rigid material.

* * * * *

UNITED STATES PATENT AND TRADEMARK OFFICE

CERTIFICATE OF CORRECTION

PATENT NO. : 4,706,720

DATED : November 17, 1987

INVENTOR(S) : O.H. Pattison et al

It is certified that error appears in the above-identified patent and that said Letters Patent is hereby corrected as shown below:

Column 2, line 45, "clip" should read -- slip --.

Signed and Sealed this

Twenty-sixth Day of April, 1988

*Attest:*

DONALD J. QUIGG

*Attesting Officer*

*Commissioner of Patents and Trademarks*

Dedication 4,706,720 — O.H. Pattison, Will Pattison, both of Clovis, N. Mex. CLEAN FUNNEL. Patent dated November 17, 1987. Dedication filed December 13, 1999, by the inventor.

Hereby dedicates to the public the entire term and all claims of said patent.

*(Official Gazette,* November 21, 2000)

US004706720C1

(12) REEXAMINATION CERTIFICATE (4295th)

United States Patent

Pattison et al.

(10) Number: US 4,706,720 C1

(45) Certificate Issued: Mar. 27, 2001

(54) CLEAN FUNNEL

(75) Inventors: O. H. Pattison; Will Pattison, both of Clovis, NM (US)

(73) Assignee: Clean Funnel, Inc., Clovis, NM (US)

Reexamination Request:
No. 90/005,462, Aug. 23, 1999

Reexamination Certificate for:

| | |
|---|---|
| Patent No.: | **4,706,720** |
| Issued: | **Nov. 17, 1987** |
| Appl. No.: | **06/842,271** |
| Filed: | **Mar. 21, 1986** |

Disclaimer of Claims 1 to 9 Filed Dec. 13, 1999 (1240 O.G. 75)

Certificate of Correction issued Apr. 26, 1988.

(51) Int. Cl.[7] ..... B67C 11/00

(52) U.S. Cl. ..... 141/327; 141/339; 215/43; 215/316; 215/321; 215/329

(58) Field of Search ..... 141/297–300, 141/106, 331–345; D7/700; D9/337, 503; D23/200, 223, 499

(56) References Cited

U.S. PATENT DOCUMENTS

| | | | | |
|---|---|---|---|---|
| D. 266,400 | * | 10/1982 | Shatz | D9/337 |
| 272,924 | | 2/1883 | Kersen . | |
| 584,275 | | 6/1897 | Sevier . | |
| 3,579,652 | | 5/1971 | Ericson . | |
| 3,750,722 | * | 8/1973 | Nowak | 141/332 |
| 3,878,571 | | 4/1975 | Seeley . | |
| 3,986,538 | | 10/1976 | Sather . | |
| 4,340,095 | | 7/1982 | Dale et al. . | |
| 4,426,027 | | 1/1984 | Maynard . | |
| 4,531,245 | | 7/1985 | Lowd et al. . | |
| 4,564,125 | * | 1/1986 | Esslinger | 141/333 |

* cited by examiner

*Primary Examiner*—J. Casimer Jacyna

(57) ABSTRACT

A clean funnel including a funnel shaped housing having a large substance intake opening and a small substance outlet opening; an entirely removable first closure cap for sealing the large substance intake opening and an entirely removable second closure cap for sealing the small substance outlet opening, the first cap and the second cap each being sufficiently tight when in place to remain in place under conditions of funnel handling and movement and to prevent contamination of the funnel during periods of nonuse.

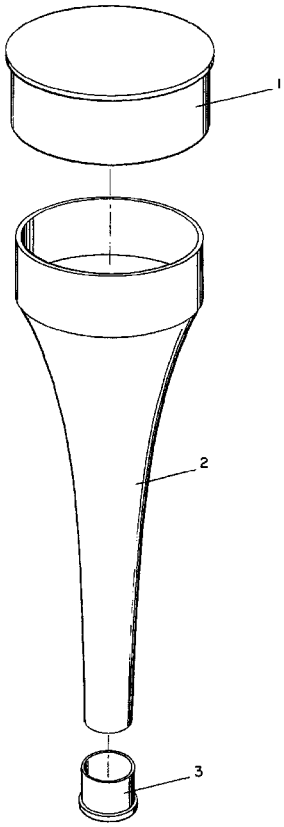

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–9 are now disclaimed.

* * * * *